US008683801B2

(12) United States Patent
Ernst et al.

(10) Patent No.: US 8,683,801 B2
(45) Date of Patent: Apr. 1, 2014

(54) RANKINE CYCLE CONDENSER PRESSURE CONTROL USING AN ENERGY CONVERSION DEVICE BYPASS VALVE

(75) Inventors: Timothy C. Ernst, Columbus, IN (US); Christopher R. Nelson, Columbus, IN (US); James A. Zigan, Versailles, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 163 days.

(21) Appl. No.: 13/209,398

(22) Filed: Aug. 13, 2011

(65) Prior Publication Data

US 2012/0042650 A1 Feb. 23, 2012

Related U.S. Application Data

(60) Provisional application No. 61/373,657, filed on Aug. 13, 2010.

(51) Int. Cl.
*F02G 3/00* (2006.01)
*F01K 23/10* (2006.01)
*F01K 13/02* (2006.01)

(52) U.S. Cl.
USPC ..... 60/615; 60/616; 60/618; 60/660

(58) Field of Classification Search
USPC ..... 60/614–624, 645–681
See application file for complete search history.

(56) References Cited

U.S. PATENT DOCUMENTS

| | | | |
|---|---|---|---|
| 3,232,052 | A | 2/1966 | Ricard |
| 3,789,804 | A | 2/1974 | Aguet |
| 4,009,587 | A | 3/1977 | Robinson, Jr. et al. |
| 4,164,850 | A | 8/1979 | Lowi, Jr. |
| 4,204,401 | A | 5/1980 | Earnest |
| 4,232,522 | A | 11/1980 | Steiger |
| 4,267,692 | A | 5/1981 | Earnest |
| 4,271,664 | A | 6/1981 | Earnest |

(Continued)

FOREIGN PATENT DOCUMENTS

| | | | |
|---|---|---|---|
| EP | 1 273 785 | B1 | 5/2007 |
| JP | 60-222511 | A | 11/1985 |

(Continued)

OTHER PUBLICATIONS

International Search Report and Written Opinion of the International Searching Authority mailed Apr. 17, 2012 from corresponding International Application No. PCT/US2011/047700.

*Primary Examiner* — Kenneth Bomberg
*Assistant Examiner* — Ngoc T Nguyen
(74) *Attorney, Agent, or Firm* — Foley & Lardner LLP

(57) ABSTRACT

The disclosure provides a waste heat recovery system and method in which pressure in a Rankine cycle (RC) system of the WHR system is regulated by diverting working fluid from entering an inlet of an energy conversion device of the RC system. In the system, an inlet of a controllable bypass valve is fluidly coupled to a working fluid path upstream of an energy conversion device of the RC system, and an outlet of the bypass valve is fluidly coupled to the working fluid path upstream of the condenser of the RC system such that working fluid passing through the bypass valve bypasses the energy conversion device and increases the pressure in a condenser. A controller determines the temperature and pressure of the working fluid and controls the bypass valve to regulate pressure in the condenser.

6 Claims, 3 Drawing Sheets

(56) References Cited

U.S. PATENT DOCUMENTS

| | | | | |
|---|---|---|---|---|
| 4,282,708 | A * | 8/1981 | Kuribayashi et al. | 60/778 |
| 4,425,762 | A * | 1/1984 | Wakamatsu et al. | 60/646 |
| 4,428,190 | A | 1/1984 | Bronicki | |
| 4,458,493 | A | 7/1984 | Amir et al. | |
| 4,471,622 | A * | 9/1984 | Kuwahara | 60/667 |
| 4,581,897 | A | 4/1986 | Sankrithi | |
| 4,630,572 | A | 12/1986 | Evans | |
| 4,831,817 | A | 5/1989 | Linhardt | |
| 4,873,829 | A | 10/1989 | Williamson | |
| 4,911,110 | A | 3/1990 | Isoda et al. | |
| 5,121,607 | A | 6/1992 | George, Jr. | |
| 5,207,188 | A | 5/1993 | Hama et al. | |
| 5,421,157 | A | 6/1995 | Rosenblatt | |
| 5,649,513 | A | 7/1997 | Kanda | |
| 5,685,152 | A | 11/1997 | Sterling | |
| 5,771,868 | A | 6/1998 | Khair | |
| 5,806,322 | A | 9/1998 | Cakmakci et al. | |
| 5,915,472 | A | 6/1999 | Takikawa et al. | |
| 5,950,425 | A | 9/1999 | Takahashi et al. | |
| 6,014,856 | A | 1/2000 | Bronicki et al. | |
| 6,035,643 | A | 3/2000 | Rosenblatt | |
| 6,055,959 | A | 5/2000 | Taue | |
| 6,138,649 | A | 10/2000 | Khair et al. | |
| 6,301,890 | B1 | 10/2001 | Zeretzke | |
| 6,321,697 | B1 | 11/2001 | Matsuda et al. | |
| 6,324,849 | B1 | 12/2001 | Togawa et al. | |
| 6,393,840 | B1 | 5/2002 | Hay | |
| 6,494,045 | B2 | 12/2002 | Rollins, III | |
| 6,523,349 | B2 | 2/2003 | Viteri | |
| 6,571,548 | B1 | 6/2003 | Bronicki et al. | |
| 6,598,397 | B2 | 7/2003 | Hanna et al. | |
| 6,606,848 | B1 | 8/2003 | Rollins, III | |
| 6,637,207 | B2 | 10/2003 | Konezciny et al. | |
| 6,701,712 | B2 | 3/2004 | Bronicki et al. | |
| 6,715,296 | B2 | 4/2004 | Bakran et al. | |
| 6,745,574 | B1 | 6/2004 | Dettmer | |
| 6,748,934 | B2 | 6/2004 | Natkin et al. | |
| 6,751,959 | B1 | 6/2004 | McClanahan et al. | |
| 6,792,756 | B2 | 9/2004 | Bakran et al. | |
| 6,810,668 | B2 | 11/2004 | Nagatani et al. | |
| 6,817,185 | B2 | 11/2004 | Coney et al. | |
| 6,848,259 | B2 | 2/2005 | Kelller-Sornig et al. | |
| 6,877,323 | B2 | 4/2005 | Dewis | |
| 6,880,344 | B2 | 4/2005 | Radcliff et al. | |
| 6,910,333 | B2 | 6/2005 | Minemi et al. | |
| 6,964,168 | B1 | 11/2005 | Pierson et al. | |
| 6,977,983 | B2 | 12/2005 | Correia et al. | |
| 6,986,251 | B2 | 1/2006 | Radcliff et al. | |
| 7,007,487 | B2 | 3/2006 | Belokon et al. | |
| 7,028,463 | B2 | 4/2006 | Hammond et al. | |
| 7,044,210 | B2 | 5/2006 | Usui | |
| 7,069,884 | B2 | 7/2006 | Baba et al. | |
| 7,117,827 | B1 | 10/2006 | Hinderks | |
| 7,121,906 | B2 | 10/2006 | Sundel | |
| 7,131,259 | B2 | 11/2006 | Rollins, III | |
| 7,131,290 | B2 | 11/2006 | Taniguchi et al. | |
| 7,159,400 | B2 | 1/2007 | Tsutsui et al. | |
| 7,174,716 | B2 | 2/2007 | Brasz et al. | |
| 7,174,732 | B2 | 2/2007 | Taniguchi et al. | |
| 7,191,740 | B2 | 3/2007 | Baba et al. | |
| 7,200,996 | B2 | 4/2007 | Cogswell et al. | |
| 7,225,621 | B2 | 6/2007 | Zimron et al. | |
| 7,281,530 | B2 | 10/2007 | Usui | |
| 7,325,401 | B1 | 2/2008 | Kesseli et al. | |
| 7,340,897 | B2 | 3/2008 | Zimron et al. | |
| 7,454,911 | B2 | 11/2008 | Tafas | |
| 7,469,540 | B1 | 12/2008 | Knapton et al. | |
| 7,578,139 | B2 | 8/2009 | Nishikawa et al. | |
| 7,665,304 | B2 | 2/2010 | Sundel | |
| 7,721,552 | B2 | 5/2010 | Hansson et al. | |
| 7,797,940 | B2 | 9/2010 | Kaplan | |
| 7,823,381 | B2 | 11/2010 | Misselhorn | |
| 7,833,433 | B2 | 11/2010 | Singh et al. | |
| 7,866,157 | B2 | 1/2011 | Ernst et al. | |
| 7,942,001 | B2 | 5/2011 | Radcliff et al. | |
| 7,958,873 | B2 | 6/2011 | Ernst et al. | |
| 7,997,076 | B2 | 8/2011 | Ernst | |
| 8,302,399 | B1 * | 11/2012 | Freund et al. | 60/605.1 |
| 2002/0099476 | A1 | 7/2002 | Hamrin et al. | |
| 2003/0033812 | A1 | 2/2003 | Gerdes et al. | |
| 2003/0213245 | A1 | 11/2003 | Yates et al. | |
| 2003/0213246 | A1 | 11/2003 | Coll et al. | |
| 2003/0213248 | A1 | 11/2003 | Osborne et al. | |
| 2005/0262842 | A1 | 12/2005 | Claassen et al. | |
| 2008/0163625 | A1 * | 7/2008 | O'Brien | 60/651 |
| 2008/0289313 | A1 * | 11/2008 | Batscha et al. | 60/39.5 |
| 2009/0031724 | A1 | 2/2009 | Ruiz | |
| 2009/0071156 | A1 * | 3/2009 | Nishikawa et al. | 60/660 |
| 2009/0090109 | A1 | 4/2009 | Mills et al. | |
| 2009/0121495 | A1 | 5/2009 | Mills | |
| 2009/0133646 | A1 | 5/2009 | Wankhede et al. | |
| 2009/0151356 | A1 | 6/2009 | Ast et al. | |
| 2009/0179429 | A1 | 7/2009 | Ellis et al. | |
| 2009/0211253 | A1 * | 8/2009 | Radcliff et al. | 60/670 |
| 2009/0241543 | A1 * | 10/2009 | Ernst | 60/645 |
| 2009/0320477 | A1 | 12/2009 | Juchymenko | |
| 2009/0322089 | A1 | 12/2009 | Mills et al. | |
| 2010/0018207 | A1 | 1/2010 | Juchymenko | |
| 2010/0071368 | A1 | 3/2010 | Kaplan et al. | |
| 2010/0083919 | A1 | 4/2010 | Bucknell | |
| 2010/0139626 | A1 | 6/2010 | Raab et al. | |
| 2010/0156112 | A1 * | 6/2010 | Held et al. | 290/1 A |
| 2010/0180584 | A1 | 7/2010 | Berger et al. | |
| 2010/0186410 | A1 * | 7/2010 | Cogswell et al. | 60/671 |
| 2010/0192569 | A1 | 8/2010 | Ambros et al. | |
| 2010/0229525 | A1 | 9/2010 | Mackay et al. | |
| 2010/0257858 | A1 | 10/2010 | Yaguchi et al. | |
| 2010/0263380 | A1 | 10/2010 | Biederman et al. | |
| 2010/0282221 | A1 | 11/2010 | Le Lievre | |
| 2010/0288571 | A1 | 11/2010 | Dewis et al. | |
| 2010/0300093 | A1 * | 12/2010 | Doty | 60/641.2 |
| 2011/0005477 | A1 | 1/2011 | Terashima et al. | |
| 2011/0006523 | A1 | 1/2011 | Samuel | |
| 2011/0048012 | A1 * | 3/2011 | Ernst et al. | 60/651 |
| 2011/0094485 | A1 | 4/2011 | Vuk et al. | |
| 2011/0203278 | A1 * | 8/2011 | Kopecek et al. | 60/660 |
| 2011/0209473 | A1 | 9/2011 | Fritz et al. | |
| 2012/0023946 | A1 | 2/2012 | Ernst et al. | |

FOREIGN PATENT DOCUMENTS

| | | | |
|---|---|---|---|
| JP | 8-68318 | A | 3/1996 |
| JP | 9-32653 | A | 2/1997 |
| JP | 10-238418 | A | 9/1998 |
| JP | 11-166453 | A | 6/1999 |
| JP | 2005-36787 | A | 2/2005 |
| JP | 2005-42618 | A | 2/2005 |
| JP | 2005-201067 | A | 7/2005 |
| JP | 2005-329843 | A | 12/2005 |
| JP | 2008-240613 | A | 10/2008 |
| JP | 2009-167995 | A | 7/2009 |
| JP | 2009-191647 | A | 8/2009 |
| JP | 2010-77964 | A | 4/2010 |
| WO | 2006/138459 | A2 | 12/2006 |
| WO | 2009/098471 | A2 | 8/2009 |

* cited by examiner

RANKINE CYCLE CONDENSER PRESSURE CONTROL USING AN ENERGY CONVERSION DEVICE BYPASS VALVE

CROSS REFERENCE TO RELATED APPLICATIONS

This application claims benefit of priority to Provisional Patent Application No. 61/373,657, filed on Aug. 13, 2010, the entire contents of which are hereby incorporated by reference.

STATEMENT REGARDING FEDERALLY SPONSORED RESEARCH OR DEVELOPMENT

This invention was made with government support under "Exhaust Energy Recovery," contract number DE-FC26-05NT42419 awarded by the Department of Energy (DOE). The government has certain rights in the invention.

FIELD OF THE INVENTION

The inventions relate to a waste heat recovery system and method, and more particularly, to a system and method in which a parameter of a Rankine cycle is regulated.

BACKGROUND

A Rankine cycle (RC) can capture a portion of heat energy that normally would be wasted ("waste heat") and convert a portion of that captured heat energy into energy that can perform useful work or into some other form of energy. Systems utilizing an RC are sometimes called waste heat recovery (WHR) systems. For example, heat from an internal combustion engine system such as exhaust gas heat energy and other engine heat sources (e.g., engine oil, exhaust gas, charge gas, water jackets) can be captured and converted to useful energy (e.g., electrical or mechanical energy). In this way, a portion of the waste heat energy can be recovered to increase the efficiency of a system including one or more waste heat sources.

FIG. 1 shows an exemplary RC system 1 including a feed pump 10, a recuperator 12, a boiler/superheater (heat exchanger) 14, an energy conversion device 16 (e.g., expander, turbine etc.), a condenser 18, and a receiver 20. The path of the RC through and between these elements contains a working fluid that the feed pump 10 moves along the path and provides as a high pressure liquid to the recuperator 12 and heat exchanger 14. The recuperator 12 is a heat exchanger that increases the thermal efficiency of the RC by transferring heat to the working fluid along a first path, and at a different point of the RC along a second path, transfers heat from the working fluid. In the first path through the recuperator 12 from the pump 10 to the boiler/superheater 14, heat stored in the recuperator is transferred to the lower temperature working fluid, and the pre-heated working fluid next enters an inlet of the boiler/superheater 14. In the boiler/superheater 14, heat from a waste heat source associated with an internal combustion engine (not shown) (e.g., exhaust gases, engine water jackets, intake air, charge air, engine oil etc.) is transferred to the high pressure working fluid, which causes the working fluid to boil and produces a high pressure vapor that exits the boiler/superheater 14 and enters an inlet of the energy conversion device. While FIG. 1 shows only a single boiler/superheater 14, more than one heat exchanger can be supplied in parallel or in series to more than one heat source associated with the engine.

The pressure and temperature of the working fluid vapor drop as the fluid moves across the energy conversion device, such as a turbine, to produce work. For example, the RC system 1 can include turbine as the energy conversion device 16 that rotates as a result of the expanding working fluid vapor. The turbine can, in turn, cause rotation of an electric generator (not shown). The electric power generated by the generator can be fed into a driveline motor generator (DMG) via power electronics (not shown). A turbine can be configured to alternatively or additionally drive some mechanical element to produce mechanical power. The additional converted energy can be transferred to the engine crankshaft mechanically or electrically, or used to power parasitics and/or storage batteries. Alternatively, the energy conversion device can be adapted to transfer energy from the RC system 1 to another system (e.g., to transfer heat energy from the RC system 1 to a fluid for a heating system). The gases exit the outlet of the energy conversion device, for example, expanded gases exiting the outlet of the turbine 16, and are then cooled and condensed via a condenser 18, which is cooled by a low temperature source (LTS) cooling medium, for example, a liquid cooling loop (circuit) including a condenser cooler having RAM airflow and condenser cooler pump (not shown) to move the cooling medium (e.g., glycol, water etc.) in the cooling loop, although other condenser cooling schemes can be employed such as a direct air-cooled heat exchanger.

The expanded working fluid vapors and liquid exiting the outlet of the turbine 16 is provided along the second path through the recuperator 12, where heat is transferred from the working fluid to be stored in the recuperator 12 before entering the condenser 18. The condenser 18 contains one or more passageways though which the working fluid vapors and liquid moves that are cooled by a cooling medium, such as a coolant or air, to cool and condense the working fluid vapors and liquid. The condensed working fluid is provided as a liquid to a receiver vessel 20 where it accumulates before moving to the feed pump 10 to complete the cycle.

The RC working fluid can be a non-organic or an organic working fluid. Some examples of working fluid are Genetron™ R-245fa from Honeywell, Therminol™, Dowtherm J from the Dow Chemical Co., Fluorinol, Toluene, dodecane, isododecane, methylundecane, neopentane, neopentane, octane, water/methanol mixtures, or steam.

SUMMARY

The disclosure provides a waste heat recovery (WHR) system and method in which pressure in a Rankine cycle (RC) system of the WHR system is regulated by diverting working fluid from entering an inlet of an energy conversion device of the RC system.

In an embodiment, a system for recovering waste heat from an internal combustion engine using a Rankine cycle (RC) system includes a heat exchanger thermally coupled to a heat source associated with the internal combustion engine and adapted to transfer heat from the heat source to working fluid of the RC system, an energy conversion device fluidly coupled to the heat exchanger and adapted to receive the working fluid having the transferred heat and convert the energy of the transferred heat, a condenser fluidly coupled to the energy conversion device and adapted to receive the working fluid from which the energy was converted, and a pump positioned in a flow path of the working fluid between the condenser and the heat exchanger and adapted to move the working fluid through the RC system. The RC system includes a bypass valve having an inlet fluidly connected between an outlet of the heat exchanger and an inlet of the energy conversion device, and an outlet fluidly connected to an inlet of the condenser. At least one sensor is positioned in the flow path of the working fluid between the condenser and the pump and adapted to sense pressure and temperature characteristics of the working fluid and generate a signal indicative of the temperature and pressure of the working fluid. The RC system includes a controller adapted to regulate the condenser pressure in the RC system via controlling the bypass valve based on the generated signal.

In another embodiment, a method is provided for regulating pressure of a working fluid in a Rankine cycle (RC) system that includes a working fluid path through a heat exchanger thermally coupled to a heat source of an internal combustion engine, through an energy conversion device in the working fluid path downstream of the heat exchanger, through a condenser in the working fluid path downstream of the energy conversion device, and through a pump in the working fluid path between the condenser and the heat exchanger. The method includes sensing the temperature and pressure of the working fluid in the working fluid path between the condenser and the pump, and if the sensed pressure of the working fluid is less than a saturation pressure of the working fluid at the monitored temperature, increasing the pressure of the working fluid in the condenser by diverting at least some of the working fluid in the working fluid path upstream of an inlet of the energy conversion device to an inlet of the condenser to bypass the energy conversion device.

DETAILED DESCRIPTION

Various aspects are described hereafter in connection with exemplary embodiments. However, the disclosure should not be construed as being limited to these embodiments. Rather, these embodiments are provided so that the disclosure will be thorough and complete, and will fully convey the scope of the disclosure to those skilled in the art. Descriptions of well-known functions and constructions may not be provided for clarity and conciseness.

The inventors have recognized that cavitation of the feed pump 10 must be overcome for efficient operation of the Rankine cycle, especially an ORC. Cavitation can result from rapid condenser pressure changes due to large engine transients or changes in condenser coolant temperature (or air temperature). The fluid in the receiver 20 can boil if the condenser pressure drops rapidly causing the feed pump 10 to cavitate when the working fluid is at saturated conditions.

Figure 1:
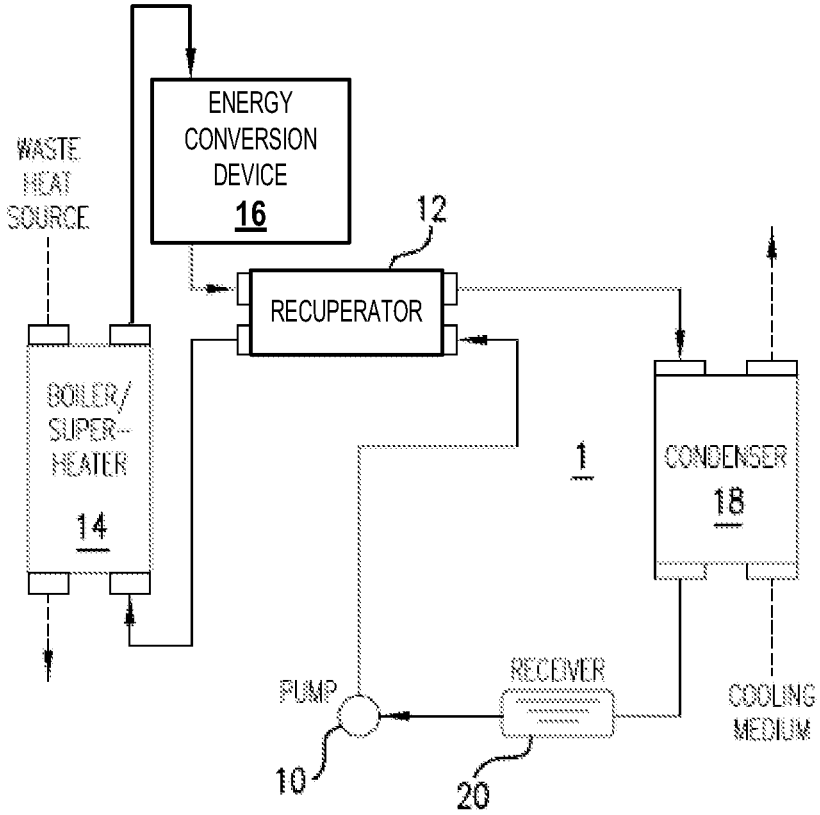
FIG. 1 is a diagram of an exemplary RC system of a WHR system.
Figure 2:
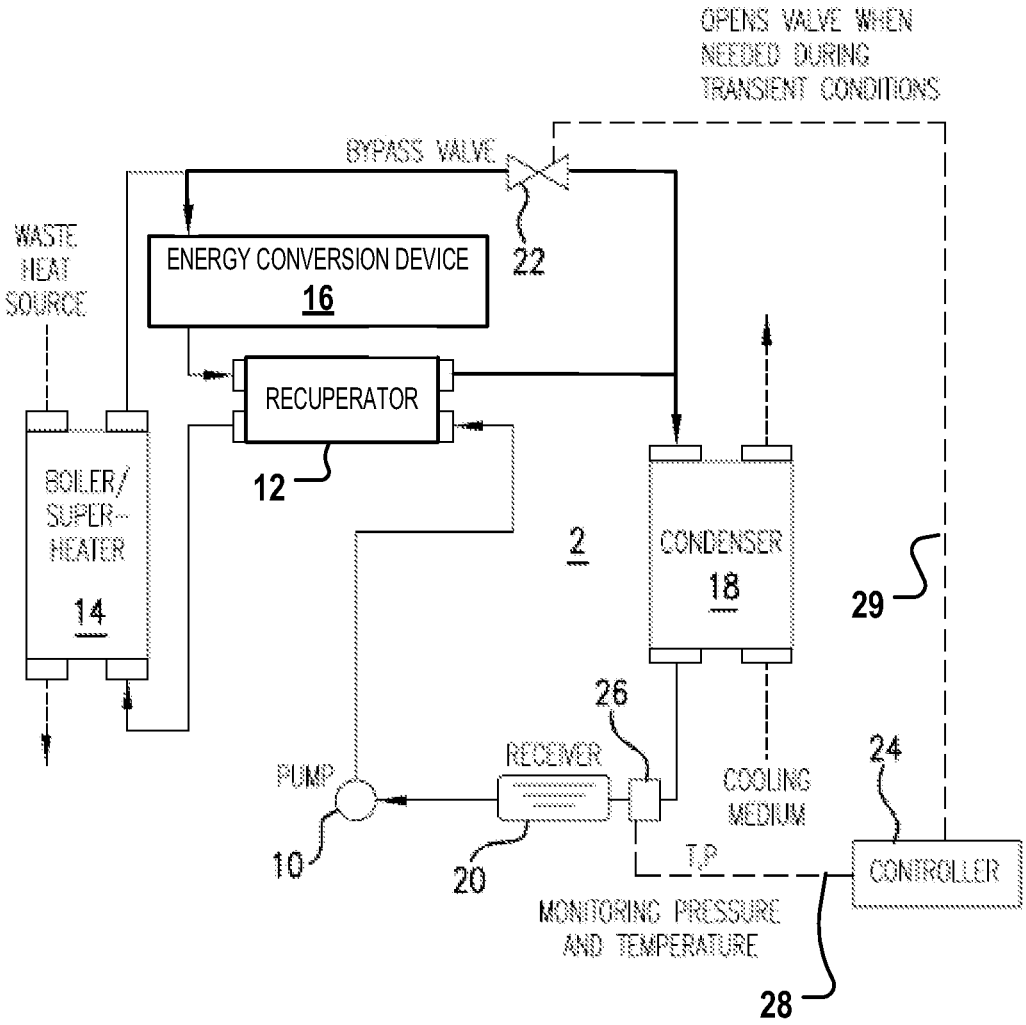
FIG. 2 is a diagram of an exemplary RC system of a WHR system including an energy conversion device and recuperator bypass valve in accordance with an exemplary embodiment.

FIG. 2 is a diagram of an exemplary RC system 2 that includes modifications of the RC 1 shown in FIG. 1. Elements having the same reference number as shown in FIG. 1 are described above. The RC system 2 includes a bypass valve 22 that can route, or divert at least some of the RC working fluid at high pressure around energy conversion device 16, and also around recuperator 12 to place additional heat load on the condenser 18 when needed during transients. Both the energy conversion device 16 and recuperator 12 remove energy from the refrigerant vapor (i.e., the RC working fluid vapor). By bypassing the energy conversion device 16 and recuperator 12, the working fluid will enter the condenser 18 at a higher temperature, and therefore a higher energy state compared with an RC system 1 in which all vaporized working fluid flows through the turbine and recuperator prior to the condenser 18. The condenser pressure is a function of the heat rejection required from it, namely, higher heat rejection requirements cause the pressure (and therefore temperature) to increase. The higher condenser temperature results in a greater temperature difference to the cooling medium (e.g., air or coolant). Since the receiver 20 is fluidly connected to the condenser 18 at approximately the same pressure as the condenser 18, the cavitation margin for the fluid in the receiver 20 is increased as pressure is increased. This prevents the feed pump 10 from losing its prime and enables the feed pump 10 to be more capable of pumping the working fluid required for cooling. Opening the turbine/recuperator bypass valve 22 also reduces the high-side pressure which reduces the pumping requirement of the feed pump 10 by reducing a required pressure rise.

As shown in FIG. 2, the RC system 2 includes a control module 24 adapted to control the energy conversion device/recuperator bypass valve 22 in either a proportional or binary manner to regulate the condenser pressure in the Rankine cycle. Sensor module 26, which is adapted to sense a pressure characteristic and a temperature characteristic of the working fluid, is provided in the path of the working fluid between the condenser and the feed pump 10 and generates a signal that is provided on communication path 28 (e.g., one or more wired or wireless communication channels). Although FIG. 2 shows only one module 26, it is to be understood that separate sensing devices can be utilized to sense temperature and pressure characteristics of the working fluid, and that these sensors can be provided at positions downstream of the condenser 18 other than that depicted. The control module 24 receives a pressure signal P and a temperature signal T from sensor module 26 and continuously or periodically monitors the pressure P and temperature T of the working fluid. From the monitored values of P and T, the controller determines whether a low pressure state exists (e.g., during a transient condition) and whether the bypass valve 22 should be opened. In an embodiment, a low pressure state is a state in which the working fluid is at or near a boiling point, i.e., the P when at or near the saturation pressure, $P_{WF,\ saturation}$ for a sensed T, and if the controller determines this state exists, it provides a signal on communication path 29 causing the bypass valve 22 to open.

Figure 3:
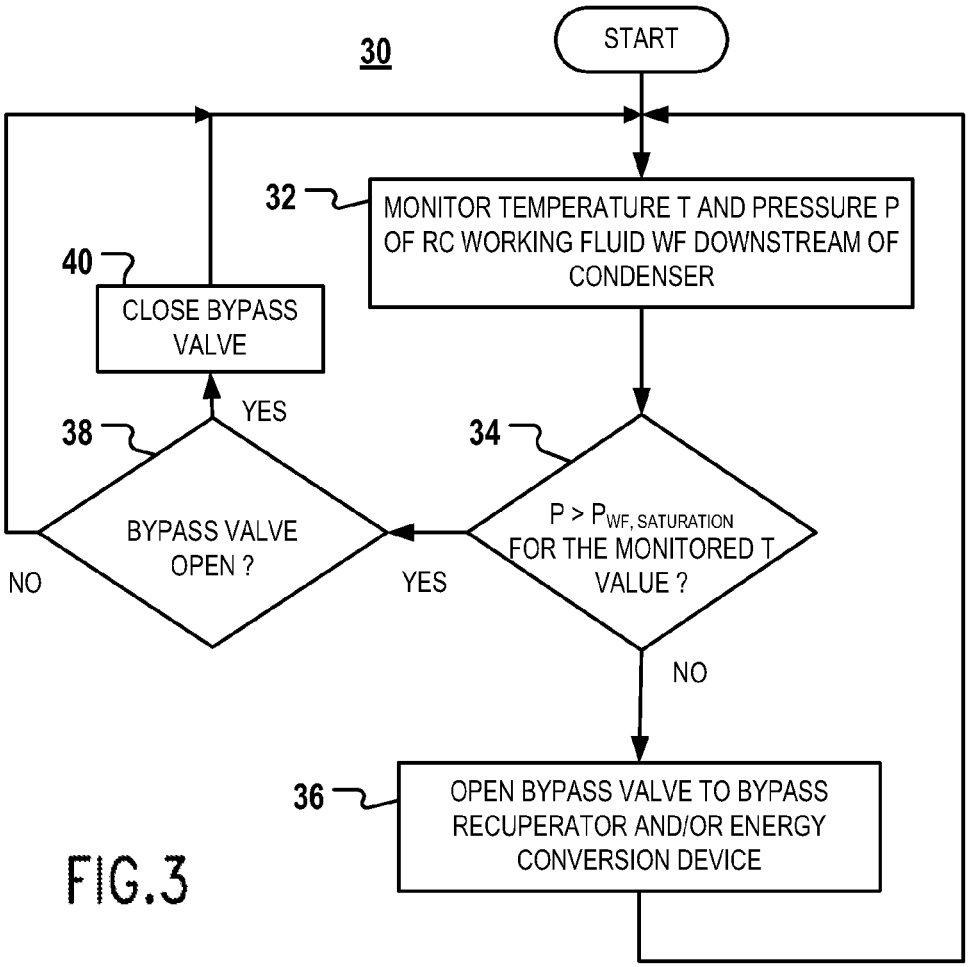
FIG. 3 shows is a flow diagram of a process for regulating pressure of a working fluid in a condenser of a Rankine cycle (RC) in accordance with an exemplary embodiment.

FIG. 3 is a process flow diagram of an exemplary method 30 that can be performed by controller 24 in an RC system 2 to determine when to open or close the bypass valve 22. With reference to FIGS. 2 and 3, in process 32 the controller 24 monitors temperature T and pressure P characteristics of the working fluid (WF) sensed downstream of the condenser 18. In decision 34, the controller 24 determines whether the sensed pressure P of the WF is greater than a saturation pressure of corresponding to the sensed T), i.e., if $P>P_{WF,\ saturation}$. If the sensed P corresponds to a pressure value less than $P_{WF,\ saturation}$, the "NO" path is take from decision 34 to process 36 in which the bypass valve 22 across a recuperator 12 and/or an energy conversion device (e.g., a turbine) 16 of the RC system is opened to increase WF pressure in a condenser 18 of the RC system 2. After performing process 36, method 30 returns to the process 32 to continue monitoring the temperature and pressure of the WF. If the controller 24 determines that the sensed P corresponds to a pressure value greater than $P_{WF,\ saturation}$, the "YES" path is take from decision 34 to process decision 38, which determines the present state of the bypass valve 22. If the controller 24 determines that the present state of bypass valve 22 is open, the "YES" path is taken to process 40, which closes the bypass valve 22. If the present state determined by controller 24 in decision 38 indicates that the bypass valve 22 is closed, the "NO" path is taken from decision 38, and the bypass valve 22 remains closed. After either case (i.e., leaving the valve 22 closed or closing it), the method returns to process 32 and the controller 24 continues to monitor the pressure P and temperature T of the WF. It is to be appreciated that other embodiments can include more granular control of the extent that the bypass valve 22 is opened, for example, based on a load prediction algorithm, operating mode, sensed transient condition, and so on.

Control of the bypass valve 22 can be accomplished using an actuator controlled by a controller, for example, controller 24 or another controller communicating with controller 24, to open the valve 22 based on the generated signal. In an exemplary embodiment, the controller can, via communication path 29, instruct valve 22 to open entirely, or as pointed out above, to an extent based on the magnitude of the transient condition. The controller 24 can determine, for example, from a lookup table, map or mathematical relation, what minimum pressure for a monitored temperature must be maintained and then control the pressure of the working fluid in the condenser via operation of the bypass valve 22 to prevent cavitation in the feed pump 10.

The control module 24 can be, for example, an electronic control unit (ECU) or electronic control module (ECM) that monitors the performance of the engine (not shown) and other elements of a vehicle. The control module 24 can be a single unit or plural control units that collectively perform these monitoring and control functions of the engine and condenser coolant system. The control module 24 can be provided separate from the coolant systems and communicate electrically with systems via one or more data and/or power paths. The control module 24 can also utilize sensors, such as pressure, temperature sensors in addition to the sensors 26 to monitor the system components and determine whether the these systems are functioning properly. The control module 24 can generate control signals based on information provided by sensors described herein and perhaps other information, for example, stored in a database or memory integral with or separate from the control module 24.

The control module 24 can include a processor and modules in the form of software or routines that are stored on computer readable media such as memory (e.g., read-only memory, flash memory etc.), which is executable by the processor of the control module. For example, instructions for carrying out the processes shown in FIG. 3 can be stored with the control module 24 or stored elsewhere, but accessible by the control module 24. In alternative embodiments, modules of control module 24 can include electronic circuits (i.e., hardware) for performing some or all or part of the processing, including analog and/or digital circuitry. These modules can comprise a combination of software, electronic circuits and microprocessor based components. The control module 24 can be an application specific module or it can receive data indicative of engine performance and exhaust gas composition including, but not limited to any of engine position sensor data, speed sensor data, exhaust mass flow sensor data, fuel rate data, pressure sensor data, temperature sensor data from locations throughout the engine and an exhaust aftertreatment system, data regarding requested power, and other data. The control module can then generate control signals and output these signals to control elements of the RC, the engine, the aftertreatment system, and/or other systems and devices associated with a vehicle.

Accordingly, a bypass valve can be controlled to bypass (or divert) hot vapor around a recuperator and/or an energy conversion device of an RC system to increase the internal energy of the fluid entering the RC system condenser, and therefore increase the pressure of the working fluid in the condenser (and receiver pressure). The increased condenser and receiver pressure is beneficial during extreme transient operation of the system because it reduces the likelihood of the feed pump losing its prime by increasing the fluid's cavitation margin. This facilitates working fluid pumping without cavitation, which facilitates achieving emission-critical cooling of EGR gases and a decrease of wear on the feed pump.

While the above embodiment is described as including a recuperator (heat exchanger), other embodiments consistent with the disclosure can be configured across the energy conversion device without a recuperator. Additionally, an embodiment of an RC system can be configured without a receiver between the condenser and the feed pump. Furthermore, the bypass valve can be used as a load limiting device for an expander (e.g., a turbine).

Embodiments of the disclosed RC system condenser pressure regulation using a bypass valve to bypass the recuperator and/or energy conversion device can be applied to any type of internal combustion engine (e.g., diesel or gasoline engines) and can provide a large improvement in fuel economy and aid in the operation of RC system during transient engine cycles (e.g., in mobile on-highway vehicle applications) and/or rapidly changing temperatures.

Although a limited number of embodiments are described herein, those skilled in the art will readily recognize that there could be variations, changes and modifications to any of these embodiments and those variations would be within the scope of the disclosure.

What is claimed is:

1. A method of regulating pressure of a working fluid in a Rankine cycle (RC) system including a working fluid path through a heat exchanger thermally coupled to a heat source of an internal combustion engine, through an energy conversion device in the working fluid path downstream of the heat exchanger, through a condenser in the working fluid path downstream of the energy conversion device, and through a pump in the working fluid path between the condenser and the heat exchanger, the method comprising:

sensing the temperature and pressure of the working fluid in the working fluid path between the condenser and the pump, if the sensed pressure of the working fluid is less than a saturation pressure of the working fluid at the sensed temperature, increasing the pressure of the working fluid in the condenser by diverting at least some of the working fluid in the working fluid path upstream of an inlet of the energy conversion device to an inlet of the condenser to bypass the energy conversion device.

2. The method of claim 1, wherein the RC system further includes a recuperator having an inlet fluidly coupled to the outlet of the energy conversion device and an outlet fluidly coupled to an inlet of the condenser, and said diverted working fluid bypasses said recuperator.

3. A system for recovering waste heat from an internal combustion engine using a Rankine cycle (RC) system, comprising:

a heat exchanger thermally coupled to a heat source associated with the internal combustion engine and configured to transfer heat from the heat source to working fluid of the RC system;

an energy conversion device fluidly coupled to the heat exchanger and configured to receive the working fluid having the transferred heat and convert the energy of the transferred heat;

a condenser fluidly coupled to the energy conversion device and configured to receive the working fluid from which the energy was converted;

a pump positioned in a flow path of the working fluid between the condenser and the heat exchanger, said pump configured to move the working fluid through the RC system;

a bypass valve having an inlet fluidly connected between an outlet of the heat exchanger and an inlet of the energy conversion device, and an outlet fluidly connected to an inlet of the condenser;

at least one sensor in the flow path of the working fluid between the condenser and the pump and configured to sense pressure and temperature characteristics of the working fluid and to generate a signal indicative of the temperature and pressure of the working fluid; and an electronic controller unit (ECU) configured to regulate the condenser pressure in the RC system via controlling the bypass valve based on the generated signal including, if the sensed pressure of the working fluid is less than a saturation pressure of the working fluid at the sensed temperature, controlling the bypass valve to increase the pressure of the working fluid in the condenser by diverting at least some of the working fluid in the working fluid path upstream of an inlet of the energy conversion device to an inlet of the condenser to bypass the energy conversion device.

4. The system of claim 3, wherein the ECU is configured to determine whether the pressure of the working fluid in the flow path is greater than a saturation pressure of the working fluid for the sensed temperature.

5. The system of claim 3, wherein the RC system includes a recuperator having an inlet fluidly coupled to the outlet of the energy conversion device and an outlet fluidly coupled to said outlet of said bypass valve.

6. The waste heat recovery system of claim 3, wherein said energy conversions device is a turbine, and said RC system further comprises a recuperator having a first path fluidly connected between an outlet of the pump and an inlet of the heat exchanger, and a second path fluidly coupled between an outlet of the energy conversion device and the inlet of the condenser, wherein the outlet of the bypass valve is connected between the inlet of the condenser and an outlet of the second path of the recuperator.

* * * * *